US010780366B1

(12) United States Patent
Yang

(10) Patent No.: US 10,780,366 B1
(45) Date of Patent: Sep. 22, 2020

(54) BUBBLE MACHINE

(71) Applicant: SHENZHEN QIAOHUA INDUSTRIES LIMITED, Shenzhen (CN)

(72) Inventor: Ruishi Yang, Shenzhen (CN)

( * ) Notice: Subject to any disclaimer, the term of this patent is extended or adjusted under 35 U.S.C. 154(b) by 0 days.

(21) Appl. No.: 16/554,650

(22) Filed: Aug. 29, 2019

(30) Foreign Application Priority Data

May 17, 2019 (CN) ..... 2019 2 0724862 U

(51) Int. Cl.
*A63H 33/28* (2006.01)
*A63H 29/22* (2006.01)

(52) U.S. Cl.
CPC ..... *A63H 33/28* (2013.01); *A63H 29/22* (2013.01)

(58) Field of Classification Search
CPC ..... A63H 33/28; A63H 29/22; A63H 3/003; A63J 5/02
USPC ..... 446/15–21
See application file for complete search history.

(56) References Cited

U.S. PATENT DOCUMENTS 2,452,794 A * 11/1948 Saachy ..... A63H 33/28 40/408
4,044,496 A * 8/1977 Jernstrom ..... A63H 33/28 446/16
4,775,348 A * 10/1988 Collins ..... A63H 33/28 446/15
5,495,876 A * 3/1996 Schramm ..... A63H 33/28 141/339
6,200,184 B1 * 3/2001 Rich ..... A63H 33/28 446/15
6,620,016 B1 * 9/2003 Thai ..... A63H 33/28 446/15
10,350,507 B2 * 7/2019 Yang ..... A63H 33/28
2012/0214378 A1 * 8/2012 Lo ..... A63H 33/28 446/15

* cited by examiner

*Primary Examiner* — Nini F Legesse
(74) *Attorney, Agent, or Firm* — HYIP

(57) ABSTRACT

The utility model discloses a bubble machine, comprising a housing and a film forming device, a liquid storage device, an air supplying device and a control device provided in the housing, therein the liquid storage device is provided with a first liquid storage chamber and a second liquid storage chamber, the second liquid storage chamber is provided below the first liquid storage chamber and is in communication with the first liquid storage chamber, the horizontal section of the second liquid storage chamber is smaller than the horizontal section of the first liquid storage chamber. The utility model fully utilizes the limited bubble liquid, avoids the waste of the bubble liquid, and increases the time of the single use of the bubble machine; in addition, the diffusion path of the bubble is more diversified and the retention time is longer.

10 Claims, 5 Drawing Sheets

BUBBLE MACHINE

TECHNICAL FIELD

The utility model relates to the field of toys or stage equipment, and more particularly to a bubble machine.

BACKGROUND

In addition to being used in children's toys, the bubble machine is also widely used in the atmosphere rendering of the stage. The bubble machine as stage equipment need to constantly generate bubbles during the stage activities, and the process of generating bubbles should not be interrupted, otherwise it will seriously affect the stage effect. The bubble liquid in the bubble machine will decrease with the use of the bubble machine. When the bubble generating unit moves to the lowest position and the height of the bubble liquid cannot submerge the bubble generating unit, the bubble machine cannot generate bubbles. The bubble machine needs to be filled or replaced with bubble liquid to continue to generate bubbles. Therefore, to ensure a good stage effect, the bubble machine has a long time of single use and can make full use of the limited bubble liquid.

In the prior art, the bubble machine uses a single chamber in which the bubble liquid is stored, and the chamber of the type is often set as a horizontal bottom surface. That is, when the bubble generating unit rotates to the lowest point, the bubble liquid can generate bubbles by submerging the bubble forming unit. When the liquid storage chamber cannot submerge the bubble forming unit, excessive residual bubble liquid is generated, and the bubbles cannot continue to be formed. Therefore, a single liquid storage chamber with a horizontal bottom surface not only produces a large amount of waste of bubble liquid, but also does not take a long time to use after being filled with the bubble liquid. It also takes a lot of time to re-add or replenish the bubble liquid, which requires more human and material resources.

SUMMARY

The utility model aims to overcome at least one of the above-mentioned deficiencies of the prior art, and to provide a bubble machine which is capable of containing more bubble liquid, making full use of bubble liquid, diffusing bubble more diversely, and significantly improving the time of single use.

The technical solution adopted by the utility model is a bubble machine, comprising a housing and a film forming device, a liquid storage device, an air supplying device and a control device provided in the housing, wherein the film forming device is provided above the liquid storage device, an air chamber is provided between the liquid storage device and the air supplying device, the air chamber comprises an air inlet and a bubble forming air outlet, the air inlet of the air chamber is opposite to the air supplying device, the bubble forming air outlet of the air chamber is opposite to the film forming device, and the control device controls the air supplying device to supply air to the film forming device through the air chamber, wherein the liquid storage device is provided with a first liquid storage chamber and a second liquid storage chamber, the bottom surface of the first liquid storage chamber is a horizontal plane, the second liquid storage chamber is provided below the first liquid storage chamber and is in communication with the first liquid storage chamber, the horizontal section of the second liquid storage chamber is smaller than the horizontal section of the first liquid storage chamber; the film forming device comprises a rotation center, a plurality of film forming units connected to the rotation center, and a motor that drives the film forming unit to rotate around the rotation center, the motor drives the film forming unit to rotate through the first liquid storage chamber, the second liquid storage chamber, the first liquid storage chamber, and the bubble forming air outlet of the air chamber in sequence.

The height of the second liquid storage chamber is greater than the height required for submerging the film forming unit.

The air supplying device comprises a motor and a fan driven by the motor.

The control device is a switch for controlling electrical communication, and is provided at an upper portion of the housing for controlling the operation of the motor of the air supplying device and the film forming device.

The effective height in which the liquid storage chamber is capable of providing bubbles to the film forming device is limited by the height of the film forming device. That is, the liquid storage chamber is generally not higher than the height of the film forming device and the film forming device extends to the position as close as possible to the bottom of the liquid storage chamber. If the storage capacity of the liquid storage chamber needs to be improved, the horizontal section of the liquid storage chamber needs to be increased, but the higher the horizontal cross-sectional area, the lower the effective utilization of the bubbles. For this reason, according to the utility model, a second liquid storage chamber is provided on the bottom surface of the original liquid storage chamber. Since the second liquid storage chamber is provided below the first liquid storage chamber, and the first liquid storage chamber is in communication with the second liquid storage chamber, the bubble liquid in the first liquid storage chamber continuously flows into the second liquid storage chamber during the consumption process. When the bubble liquid level of the first liquid storage chamber is lower than the bottom surface of the first liquid storage chamber, the bubble liquid converges to the second liquid storage chamber. Since the horizontal section of the second liquid storage chamber is smaller than the horizontal section of the first liquid storage chamber, the remaining bubble liquid can still maintain a higher liquid, level in the second liquid storage chamber, and can still submerge the passing film forming unit. At the same time, the motor drives the film forming unit to rotate from the first liquid storage chamber to the second liquid storage chamber, and passes through the second liquid storage chamber. That is, when the water level of the bubble liquid in the first liquid storage chamber is lowered below the bottom surface of the first liquid storage chamber, the film forming unit continues to form bubbles by the remaining bubble liquid collected by the second liquid storage chamber until the bubble liquid of the second liquid storage chamber cannot submerge the passing film forming unit, thereby reducing the waste of the bubble liquid, making full use of the same volume of bubble liquid, increasing the time of single use of the bubble machine; as long as the horizontal section of the first liquid storage chamber is increased, a larger volume can be provided to the bubble liquid, facilitating to accommodate more bubble fluid while still ensuring that the bubble fluid is fully utilized.

In the same volume of bubble liquid, the bubble machine in the prior art often uses a single liquid storage chamber and the bottom surface of the liquid storage chamber is a horizontal plane. There is no extra space to accommodate the bubble liquid, and the remaining bubble liquid collected during use cannot be used either. When the bubble liquid cannot submerge the film forming unit, the volume of the remaining bubble liquid is $V_1$. In the utility model, the first and second liquid storage chambers are provided in the upper part and the lower part, and the horizontal section of the second liquid storage chamber is smaller than the horizontal section of the first liquid storage chamber to collect the remaining bubble liquid and increase the liquid level of the bubble liquid. Therefore, the remaining bubble liquid is used to generate bubbles; the same volume of the remaining bubble liquid cannot submerge the film forming unit in a single chamber, and the second liquid storage chamber in double chambers can still submerge the film forming unit, and continue to generate bubbles until the bubble liquid of the second liquid storage chamber cannot submerge the film forming unit. At this time, the volume of the remaining bubble liquid in the second liquid storage chamber is $V_2$, and it is easy to know that $V_2$ is much smaller than $V_1$.

The projection of the second liquid storage chamber on the plane of rotation of the film forming unit is arc-shaped. Since the motor drives the film forming unit to rotate, the movement path of the film forming unit is circular or arc-shaped. The second liquid storage chamber is designed to be arc-shaped to facilitate to be fit with the movement trajectory of the film forming unit, so that the volume of bubble liquid collected to submerge the film forming unit is less, and the waste of the bubble liquid at the corner is also avoided. Moreover, the arc shape is more favorable for increasing the liquid level of the bubble liquid than other shapes, and helps to make full use of the remaining bubble liquid and improve the utilization rate of the remaining bubble liquid.

The bubble forming air outlet of the air chamber comprises a first air outlet and a second air outlet, the second air outlet is provided below the first air outlet, a deflecting air outlet is provided below the second air outlet, the opening direction of the deflecting air outlet is inclined upward or horizontally forward, and the deflecting air outlet is communicated with the air chamber. The second air outlet is opposite to the passing film forming unit. Airflow flows out of the second air outlet to blow the film forming unit with bubble liquid to form bubbles. The first air outlet is provided above the second air outlet, helping the second air outlet to form bubbles. The deflecting air outlet is provided below the second air outlet. When the opening direction of the deflecting air outlet is inclined upward, the airflow of the deflecting air outlet blows the bubble to move upward, so that the diffusion of the bubble is not limited to the horizontal movement and downward movement, increasing the diversity of the diffusion direction of the bubble and keeping the bubble in the air for a longer period of time. When the opening direction of the deflecting air outlet is horizontally forward, the airflow level of the deflecting air outlet is moved forward, and the bubble is blown further. In combination with the rotation of the film forming unit, the airflow has an unsteady flow direction, helping the bubble spread around. The horizontal size of the deflecting air outlet is smaller than that of the first and second air outlets, so as to prevent excessive airflow from flowing to the deflecting air outlet, thereby affecting the first and second air outlets to form bubbles.

The front end of the air chamber forms an inclined air supplying surface, a horizontal plate is provided between the upper edge of the air supplying surface and the upper surface of the housing, a first air outlet is formed between the horizontal plate and the housing, the horizontal plate is in non-direct contact with the upper surface of the housing, a second air outlet is formed between the horizontal plate and the air supplying surface, and a deflecting air outlet is formed below the upper edge of the air supplying surface. The inclined air supplying surface contributes to making full use of the airflow, realizes a smooth transition of the airflow, and can directly guide the airflow to move to the first and second air outlets. The isolation and design of the air outlet are realized by a simple horizontal plate to reduce the processing difficulty of the bubble machine.

The deflecting air outlet is provided with a detachable plug board for switching the opening direction of the deflecting air outlet. The detachable plug board is provided, helping to adjust the diffusion mode of bubbles according to actual needs, helping to adjust the structure of the bubble machine according to the actual use, and having a wider use range.

The front end of the upper surface of the housing is provided as a parabolic opening, the opening is oriented toward the front end, and a first air outlet is formed between the opening and the horizontal plate. The first air outlet consists of a first horizontal plate and a housing whose front end is a parabolic opening, and has a horizontal air outlet direction and a vertical air outlet direction at the same time. The horizontal air outlet direction helps the second air outlet form a bubble. The vertical air outlet direction can dredge the airflow and prevent the airflow from being too large to form a bubble when the airflow is large.

The housing is provided with a battery mounting groove and a power supply port. A dry battery is used to supply power to facilitate carrying, and is more suitable for children's toys; the power supply port can be powered by a Charge Pal. When there is no battery or the battery has no power, the Charge Pal that is carried can keep the bubble machine running, avoiding the situation that the bubble machine cannot be used because the battery is exhausted. It is suitable for use when travelling outside. The bubble machine has two modes of battery operation and Charge Pal charging operation, and the scope of application is wider.

The film forming unit is connected to the rotation center through a connecting rod, and the connecting rod is provided with a flow separating portion; the flow separating portion is a triangular or fan-shaped planar structure; and the airflow flowing out from the deflecting air outlet meets the passing flow separating portion to separate the airflow. As the rotation center rotates, the flow separating portion on the connecting rod also rotates. Various airflow changes can be made in conjunction with the airflow flowing out of the deflecting air outlet, providing more diffusion paths to bubbles.

The inner wall of the film forming unit is provided with a plurality of first protrusions radially arranged around the center of the film forming unit, and/or the upper and lower surfaces of the film forming unit are provided with a plurality of second protrusions.

The housing opposite to the air supplying device is provided with a water droplet-shaped ventilation hole, and the water droplet-shaped ventilation hole is arranged in a circumferential array. The water droplet-shaped ventilation hole can realize a large ventilation area under the same area. The circular array arrangement helps to achieve uniform gas flow. The water droplet-shaped circular array arrangement can effectively utilize the limited ventilation area and improve the air supplying efficiency of the air supplying device.

Compared with the prior art, the beneficial effects of the utility model are as follows:

1. reducing the waste of bubble liquid;
2. making full use of the limited bubble liquid;
3. having a longer time of single use of the bubble machine under the same volume of bubble liquid;
4. having a longer retention time of bubble;
5. having a more diverse diffusion path of bubbles;
6. having more extensive scope of application.

DESCRIPTION OF THE EMBODIMENTS

The drawings of the utility model are for illustrative purposes only and are not to be construed as limiting the utility model. In order to better illustrate the following embodiments, some components of the drawings may be omitted, enlarged or reduced, and do not represent the dimensions of actual products; some known structures and their descriptions may be omitted, which is understandable to those skilled in the art.

Embodiment 1

Figure 1:
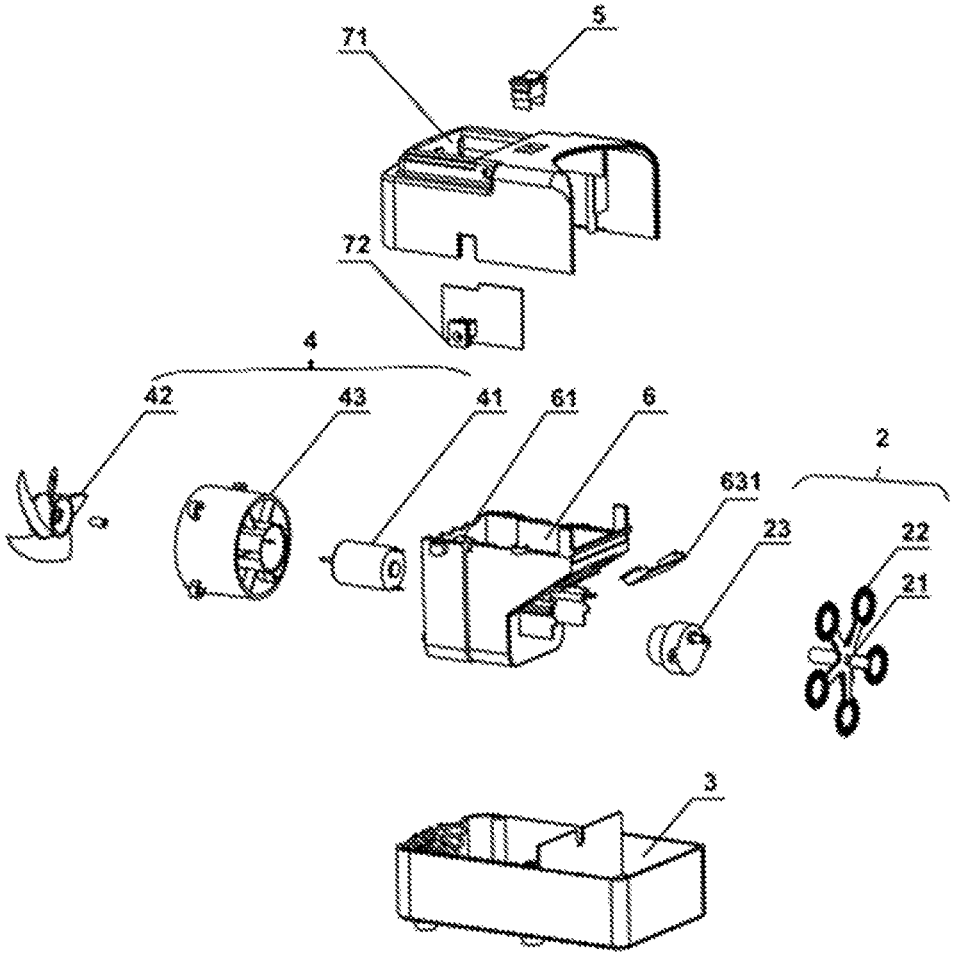
FIG. 1 is an exploded view according to the utility model.
Figure 2:
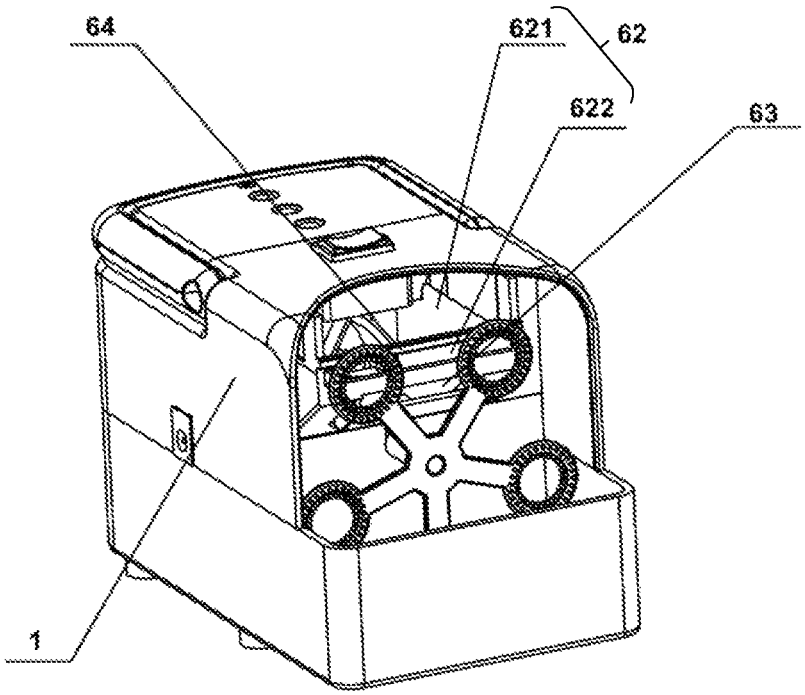
FIG. 2 is a perspective view according to the utility model.
Figure 3:
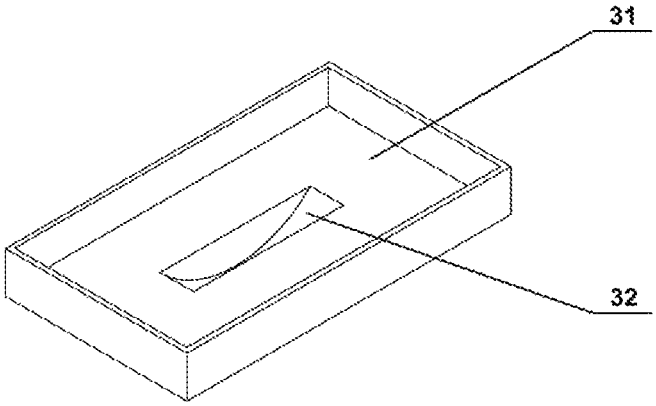
FIG. 3 is a schematic view of a first liquid storage chamber and a second liquid storage chamber.

As shown in FIGS. 1 to 3, a bubble machine comprises a housing 1 and a film forming device 2, a liquid storage device 3, an air supplying device 4, and a control device 5 provided in the housing, wherein the film forming device 2 is provided above the liquid storage device 3, an air chamber 6 is provided between the liquid storage device 3 and the air supplying device 4, the air chamber comprises an air inlet 61 and a bubble forming air outlet 62, the air inlet 61 of the air chamber is opposite to the air supplying device 4, the bubble forming air outlet 62 of the air chamber is opposite to the film forming device 2, and the control device 5 controls the air supplying device 4 to supply air to the film forming device 2 through the air chamber 6, wherein the liquid storage device 3 is provided with a first liquid storage chamber 31 and a second liquid storage chamber 32, the second liquid storage chamber 32 is provided below the first liquid storage chamber 31 and is in communication with the first liquid storage chamber 31, the horizontal section of the second liquid storage chamber 32 is smaller than the horizontal section of the first liquid storage chamber 31, the film forming device 2 comprises a rotation center 21, a plurality of film forming units 22 connected to the rotation center, and a motor 23 that drives the film forming unit to rotate around the rotation center, the motor 23 drives the film forming unit 22 to rotate through the first liquid storage chamber 31, the second liquid storage chamber 32, the first liquid storage chamber 31, and the bubble forming air outlet 62 of the air chamber in sequence.

The air supplying device 4 is a fan 42 driven by a motor 41, and the motor 41 is mounted in the circular fixing column 43 and is connected to the fan 42.

The control device 5 is a switch for controlling electrical communication, and is provided at an upper portion of the housing for controlling the operation of the motor of the air supplying device 4 and the film forming device 2.

The projection of the second liquid storage chamber 32 on the plane of rotation of the film forming unit 22 is arc-shaped.

The bubble forming air outlet 62 of the air chamber comprises a first air outlet 621 and a second air outlet 622, the second air outlet 622 is provided below the first air outlet 621, a deflecting air outlet 63 is provided below the second air outlet 622, the opening direction of the deflecting air outlet 63 is inclined upward or horizontally forward, and the deflecting air outlet 63 is communicated with the air chamber 6. The deflecting air outlet 63 is provided with a detachable plug board 631 for switching the opening direction of the deflecting air outlet 63.

The front end of the air chamber 6 forms an inclined air supplying surface, a horizontal plate 64 is provided between the upper edge of the air supplying surface and the upper surface of the housing, the front end of the upper surface of the housing 1 is provided as a parabolic opening, the opening is oriented toward the front end, a first air outlet 621 is formed between the opening and the horizontal plate 64, a second air outlet 622 is formed between the horizontal plate 64 and the air supplying surface, and a deflecting air outlet 63 is formed below the upper edge of the air supplying surface.

The film forming unit 22 is connected to the rotation center 21 through a connecting rod, and the connecting rod is provided with a flow separating portion 24.

The housing is provided with a battery mounting groove 71 and a power supply port 72.

Figure 4:
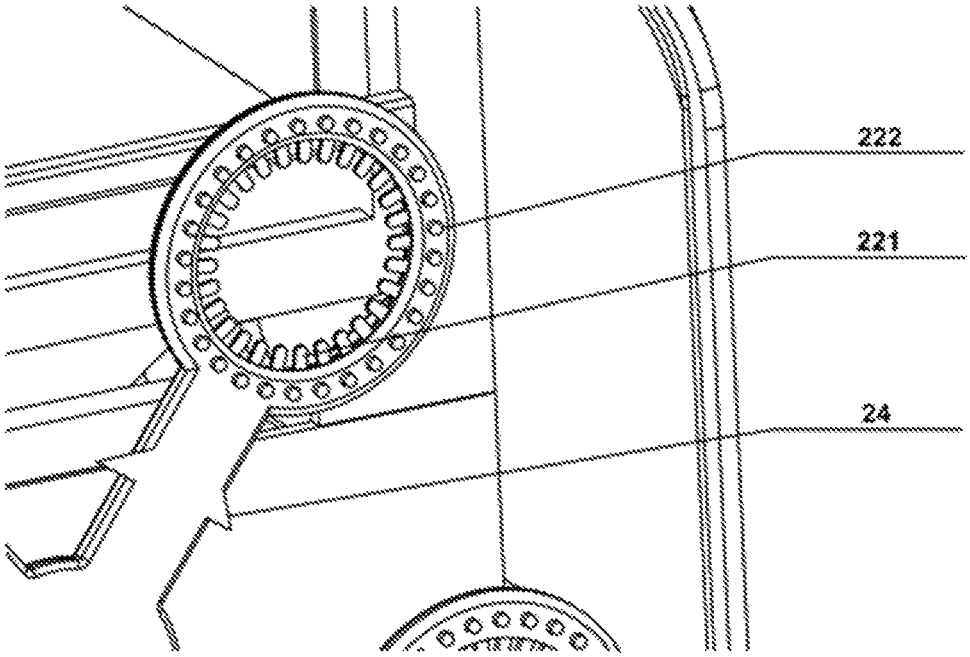
FIG. 4 is a partial enlarged view of a film forming device.

As shown in FIG. 4, the inner wall of the film forming unit is provided with a plurality of first protrusions 221 radially arranged around the center of the film forming unit, and/or the upper and lower surfaces of the film forming unit are provided with a plurality of second protrusions 222.

Figure 5:
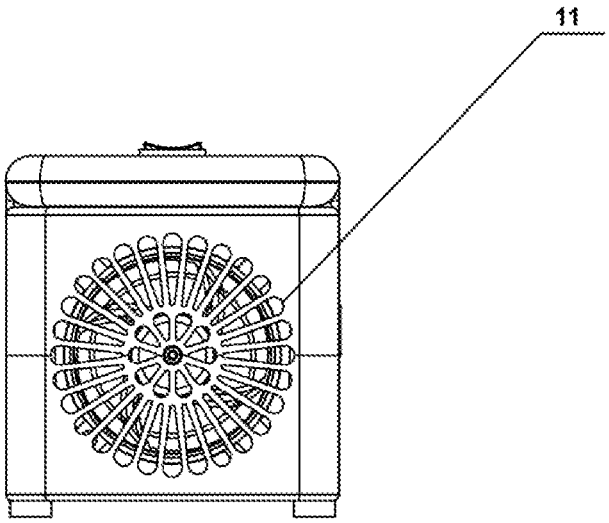
FIG. 5 is a schematic view of a ventilation hole.

As shown in FIG. 5, the housing opposite to the air supplying device 4 is provided with a water droplet-shaped ventilation hole 11, and the water droplet-shaped ventilation hole is arranged in a circumferential array.

Working principle: after the battery is mounted to the battery mounting groove 71, the motor 41 and the motor 23 in the bubble machine are activated by the switch 5, the motor 41 drives the fan 42 to take in air from the ventilation hole 11 to the air inlet 61 of the air chamber 6, and flows the airflow to the first air outlet 621, the second air outlet 622, and the deflecting air outlet 63 through the inclined surface in the air chamber 6. At the same time, the motor 23 drives the film forming unit 22 to rotate through the first liquid storage chamber 31, the second liquid storage chamber 32 and the first liquid storage chamber 31 and is immersed in the bubble liquid; the airflow flowing out from the second air outlet 622 is blown to the passing film forming unit 22 to promote bubble formation. The horizontal ventilation of the first air outlet 621 helps the second air outlet 622 blow toward the film forming unit. The deflecting air outlet 63 to which the detachable plug board 631 is mounted is inclined upward and is ventilated to blow the bubble upward. Alternatively, the plug board 631 can be detached. The deflecting air outlet 63 is ventilated horizontally forward and passes through the flow separating portion 24 so as to diffuse the bubbles in a plurality of directions. During the bubble liquid consumption process, the bubble liquid in the first liquid storage chamber 31 continuously flows to the second liquid storage chamber 32 until the bubble liquid level is lower than the bottom surface of the first liquid storage chamber 31, and the film forming unit 22 passes through the first liquid storage chamber 31, the second liquid storage chamber 32, and the first liquid storage chamber 31 in sequence, but the film forming unit 22 is only immersed in the bubble liquid in the second liquid storage chamber 32 until the bubble liquid of the second liquid storage chamber 32 cannot submerge the passing film forming unit 22.

The above embodiments of the utility model are merely illustrative of the technical solutions of the utility model, and are not intended to limit the specific embodiments of the utility model. Any modifications, equivalent substitutions and improvements made within the spirit and scope of the claims of the utility model are intended to be included within the scope of protection of the claims of the utility model.

What is claimed is:

1. A bubble machine, comprising a housing and a film forming device, a liquid storage device, an air supplying device and a control device provided in the housing, wherein the film forming device is provided above the liquid storage device, an air chamber is provided between the liquid storage device and the air supplying device, wherein the air chamber comprises an air inlet and a bubble forming air outlet, the air inlet of the air chamber is opposite to the air supplying device, the bubble forming air outlet of the air chamber is opposite to the film forming device, and the control device controls the air supplying device to supply air to the film forming device through the air chamber, wherein the liquid storage device is provided with a first liquid storage chamber and a second liquid storage chamber, wherein the second liquid storage chamber is provided below the first liquid storage chamber and is in communication with the first liquid storage chamber, a horizontal section of the second liquid storage chamber is smaller than a horizontal section of the first liquid storage chamber; the film forming device comprises a rotation center, a plurality of film forming units connected to the rotation center, and a motor that drives the film forming unit to rotate around the rotation center, wherein the motor drives the film forming unit to rotate through a first portion of the first liquid storage chamber, the second liquid storage chamber, and a second portion of the first liquid storage chamber in sequence, and then rotate to be opposite to the bubble forming air outlet of the air chamber.

2. The bubble machine according to claim 1, wherein a projection of the second liquid storage chamber on a plane of rotation of the film forming unit is arc-shaped.

3. The bubble machine according to claim 1, wherein the bubble forming air outlet of the air chamber comprises a first air outlet and a second air outlet, the second air outlet is provided below the first air outlet, a deflecting air outlet is provided below the second air outlet, an opening direction of the deflecting air outlet is inclined upward or horizontally forward, and the deflecting air outlet is communicated with the air chamber.

4. The bubble machine according to claim 3, wherein a front end of the air chamber forms an inclined air supplying surface, a horizontal plate is provided between an upper edge of the air supplying surface and an upper surface of the housing, a first air outlet is formed between a horizontal plate and the housing, a second air outlet is formed between the horizontal plate and the air supplying surface, and a deflecting air outlet is formed below the upper edge of the air supplying surface.

5. The bubble machine according to claim 4, wherein a front end of the upper surface of the housing is provided as a parabolic opening, the opening is oriented toward the front end of the upper surface of the housing, and a first air outlet is formed between the opening and the horizontal plate.

6. The bubble machine according to claim 3, wherein the deflecting air outlet is provided with a detachable plug board for switching the opening direction of the deflecting air outlet.

7. The bubble machine according to claim 1, wherein the film forming unit is connected to the rotation center through a connecting rod, and the connecting rod is provided with a flow separating portion.

8. The bubble machine according to claim 1, wherein the housing is provided with a battery mounting groove and a power supply port.

9. The bubble machine according to claim 1, wherein an inner wall of the film forming unit is provided with a plurality of first protrusions radially arranged around a center of the film forming unit, and/or upper and lower surfaces of the film forming unit are provided with a plurality of second protrusions.

10. The bubble machine according to claim 1, wherein the housing opposite to the air supplying device is provided with a water droplet-shaped ventilation hole, and the water droplet-shaped ventilation hole is arranged in a circumferential array.

* * * * *